US010471750B2

(12) United States Patent
Hirokawa et al.

(10) Patent No.: US 10,471,750 B2
(45) Date of Patent: Nov. 12, 2019

(54) PRINTING APPARATUS, LIQUID ABSORBING APPARATUS, CONTROL METHOD

(71) Applicant: CANON KABUSHIKI KAISHA, Tokyo (JP)

(72) Inventors: Ryosuke Hirokawa, Kawasaki (JP); Makoto Terui, Yokohama (JP); Kyosuke Deguchi, Yokohama (JP); Yoshiyuki Honda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/020,227

(22) Filed: Jun. 27, 2018

(65) Prior Publication Data

US 2019/0009589 A1 Jan. 10, 2019

(30) Foreign Application Priority Data

Jul. 4, 2017 (JP) ..... 2017-131491

(51) Int. Cl.

| | |
|---|---|
| ***B41J 2/165*** | (2006.01) |
| ***B41J 29/17*** | (2006.01) |
| ***B41J 2/005*** | (2006.01) |
| ***B41J 2/01*** | (2006.01) |

(52) U.S. Cl.

CPC ..... *B41J 29/17* (2013.01); *B41J 2/0057* (2013.01); *B41J 2/01* (2013.01); *B41J 2002/012* (2013.01)

(58) Field of Classification Search

USPC ..... 347/103

See application file for complete search history.

(56) References Cited

U.S. PATENT DOCUMENTS

| | | | | |
|---|---|---|---|---|
| 6,390,617 | B1 * | 5/2002 | Iwao | B41J 2/01 347/102 |
| 6,682,189 | B2 | 1/2004 | May et al. | |
| 6,767,092 | B2 | 7/2004 | May et al. | |
| 2007/0229586 | A1 * | 10/2007 | Hirakawa | B41J 2/0057 347/31 |

(Continued)

FOREIGN PATENT DOCUMENTS

JP 2003-182064 A 7/2003

OTHER PUBLICATIONS

U.S. Appl. No. 16/015,734, filed Jun. 22, 2018, Ryosuke Hirokawa Minoru Nozawa Toshimori Miyakoshi.

(Continued)

*Primary Examiner* — Lam S Nguyen

(74) *Attorney, Agent, or Firm* — Venable LLP

(57) ABSTRACT

A liquid absorbing apparatus for absorbing a liquid component from a formed ink image includes an endless liquid absorbing sheet, a mechanism configured to move the liquid absorbing sheet cyclically, an absorption mechanism configured to absorb the liquid component from the ink image by making the liquid absorbing sheet contact the ink image, a removing mechanism configured to squeeze and remove a liquid with a nipping pressure by nipping the liquid absorbing sheet, and at least one nipping portion, different from the absorption mechanism and the removing mechanism, configured to nip the liquid absorbing sheet. In the apparatus, the nipping pressure of the removing mechanism is set higher than a nipping pressure of the nipping unit.

20 Claims, 12 Drawing Sheets

(56) References Cited

U.S. PATENT DOCUMENTS

| | | | | |
|---|---|---|---|---|
| 2012/0105541 | A1* | 5/2012 | Inoue | B41J 2/0057 347/31 |
| 2012/0105562 | A1* | 5/2012 | Sekiguchi | B41J 2/01 347/103 |
| 2017/0217191 | A1 | 8/2017 | Hirokawa et al. | |
| 2017/0217216 | A1 | 8/2017 | Ohnishi et al. | |
| 2018/0311951 | A1 | 11/2018 | Sakamoto et al. | |
| 2018/0326719 | A1 | 11/2018 | Masuda et al. | |
| 2018/0326755 | A1 | 11/2018 | Ohnishi et al. | |
| 2018/0326756 | A1 | 11/2018 | Hirokawa et al. | |

OTHER PUBLICATIONS

U.S. Appl. No. 16/015,976, filed Jun. 22, 2018, Kyosuke Deguchi Ryosuke Hirokawa Makoto Terui Yoshiyuki Honda.

U.S. Appl. No. 16/020,015, filed Jun. 27, 2018, Yoichi Takada Ryosuke Hirokawa Mitsutoshi Noguchi Shingo Okushima Toru Ohnishi.

* cited by examiner

FIG. 10

| | POROUS MATERIAL | | | | NIPPING PRESSURE [MPa] | | CONTACT AREA BETWEEN LIQUID ABSORBING MEMBER AND NIPPING PORTION [mm²] | | DETERMINA -TION | |
|---|---|---|---|---|---|---|---|---|---|---|
| | AVERAGE PORE SIZE | | COMPRESSIVE MODULUS [MPa] | | | | | | | |
| | OBVERSE LAYER | REVERSE LAYER | OBVERSE LAYER | REVERSE LAYER | CLEAN -ING | COLLEC -TION | OBVERSE LAYER (S1) | REVERSE LAYER (S2) | LIQUID LEAKAGE | COLLEC -TION |
| EXAMPLE 1 | 3μm | — | 1.5 | — | 0.1 | 0.15 | 8000 (NIPPING WIDTH:10mm) | 8000 (NIPPING WIDTH:10mm) | B | B |
| EXAMPLE 2 | 3μm | — | 1.5 | — | 0.1 | 0.2 | 8000 (NIPPING WIDTH:10mm) | 8000 (NIPPING WIDTH:10mm) | B | A |
| EXAMPLE 3 | 3μm | — | 1.5 | — | 0.15 | 0.3 | 9600 (NIPPING WIDTH:12mm) | 9600 (NIPPING WIDTH:12mm) | B | A |
| EXAMPLE 4 | 3μm | 20μm | 1.5 | 0.8 | 0.1 | 0.3 | 8000 (NIPPING WIDTH:10mm) | 8000 (NIPPING WIDTH:10mm) | B | A |
| EXAMPLE 5 | 3μm | 20μm | 1.5 | 0.8 | 0.1 | 0.3 | 8000 (NIPPING WIDTH:10mm) | 16746 (WINDING ANGLE 30°) | A | AA |
| EXAMPLE 6 | 3μm | 20μm | 1.5 | 0.8 | 0.1 | 0.3 | 8000 (NIPPING WIDTH:10mm) | 50240 (WINDING ANGLE 90°) | A | AA |
| EXAMPLE 7 | 0.2μm | 20μm | 1.5 | 0.8 | 0.1 | 0.3 | 8000 (NIPPING WIDTH:10mm) | 50240 (WINDING ANGLE 90°) | AA | AA |
| COMPARATIVE EXAMPLE 1 | 3μm | — | 1.5 | — | 0.2 | 0.1 | 11200 (NIPPING WIDTH:14mm) | 11200 (NIPPING WIDTH:14mm) | C | C |
| COMPARATIVE EXAMPLE 2 | 3μm | — | 1.5 | — | 0.3 | 0.1 | 12800 (NIPPING WIDTH:16mm) | 12800 (NIPPING WIDTH:16mm) | C | C |

PRINTING APPARATUS, LIQUID ABSORBING APPARATUS, CONTROL METHOD

BACKGROUND OF THE INVENTION

Field of the Invention

The present invention relates to a technique of transferring an ink image to a print medium.

Description of the Related Art

A technique of forming an ink image on a transfer member and transferring it to a print medium such as paper is proposed. For example, Japanese Patent Laid-Open No. 2003-182064 discloses an image forming apparatus for forming an ink image on an intermediate member and transferring the ink image to a sheet. This apparatus includes an inkjet device that forms a primary image on the intermediate member. This apparatus also includes a zone where an aggregate is formed in the primary image, a zone where a liquid is partially removed from the aggregate, a zone where an image is transferred to a sheet, and a zone where the surface of the intermediate member is reproduced before a new primary image is formed.

A liquid absorbing sheet that absorbs a liquid component of an ink image requires a mechanism of taking out the absorbed liquid from the liquid absorbing sheet such as a mechanism of squeezing the liquid component by nipping the liquid absorbing sheet. When the mechanism of squeezing the liquid component is used, if, for example, there exists a portion where the liquid absorbing sheet is nipped in addition to a position at which the liquid is squeezed, the liquid may be squeezed in the nipping portion, causing liquid leakage in the apparatus.

SUMMARY OF THE INVENTION

The present invention provides a technique of suppressing liquid leakage from a liquid absorbing sheet that absorbs a liquid component of an ink image.

According to one aspect of the present invention, there is provided a printing apparatus comprising: a transfer member configured to be moved cyclically; a print unit configured to form an ink image on the transfer member by discharging ink to the transfer member; a transfer unit configured to perform a transfer operation of transferring, to a print medium, the ink image formed on the transfer member; and a liquid absorbing unit configured to absorb a liquid component from the ink image on the transfer member before the transfer operation, the liquid absorbing unit including an endless liquid absorbing sheet, a driving unit configured to move the liquid absorbing sheet cyclically, an absorption unit configured to absorb the liquid component from the ink image by making the liquid absorbing sheet contact the ink image, a removing unit configured to squeeze and remove a liquid with a nipping pressure by nipping the liquid absorbing sheet, and at least one nipping unit, different from the absorption unit and the removing unit, configured to nip the liquid absorbing sheet, wherein the nipping pressure of the removing unit is set higher than a nipping pressure of the nipping unit.

According to another aspect of the present invention, there is provided a liquid absorbing apparatus for absorbing a liquid component from a formed ink image, comprising: an endless liquid absorbing sheet; a driving unit configured to move the liquid absorbing sheet cyclically; an absorption unit configured to absorb the liquid component from the ink image by making the liquid absorbing sheet contact the ink image; a removing unit configured to squeeze and remove a liquid with a nipping pressure by nipping the liquid absorbing sheet; and at least one nipping unit, different from the absorption unit and the removing unit, configured to nip the liquid absorbing sheet, wherein the nipping pressure of the removing unit is set higher than a nipping pressure of the nipping unit.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 10 is a table for explaining the relationship between conditions of a liquid absorbing mechanism and liquid leakage and liquid collection;

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Embodiments of the present invention will be described below with reference to the accompanying drawings. In each view, arrows X and Y indicate horizontal directions perpendicular to each other. An arrow Z indicates a vertical direction.

<Printing System>

Figure 1:
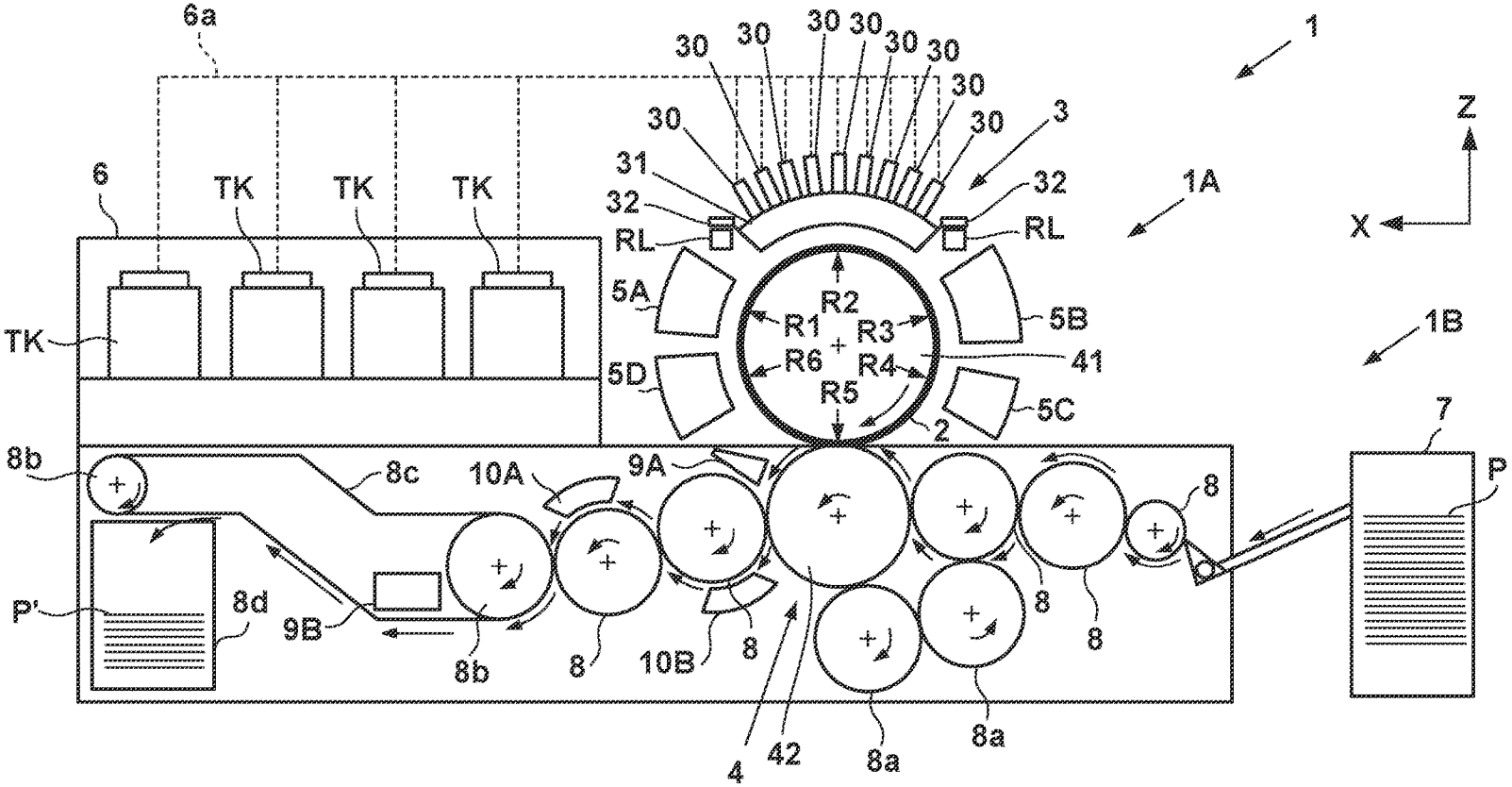
FIG. 1 is a schematic view showing a printing system.

FIG. 1 is a front view schematically showing a printing system (printing apparatus) 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Note that "print" includes not only formation of significant information such as a character or graphic pattern but also formation of an image, design, or pattern on a print medium in a broader sense or processing of a print medium regardless of whether the information is significant or insignificant or has become obvious to allow human visual perception. In this embodiment, a "print medium" is assumed to be a paper sheet but may be a fabric, plastic film, or the like.

An ink component is not particularly limited. In this embodiment, however, a case is assumed in which aqueous pigment ink that includes a pigment as a coloring material, water, and a resin is used.

<Printing Apparatus>

The printing apparatus 1A includes a print unit 3, a transfer unit 4, peripheral units 5A to 5D, and a supply unit 6.

<Print Unit>

Figure 2:
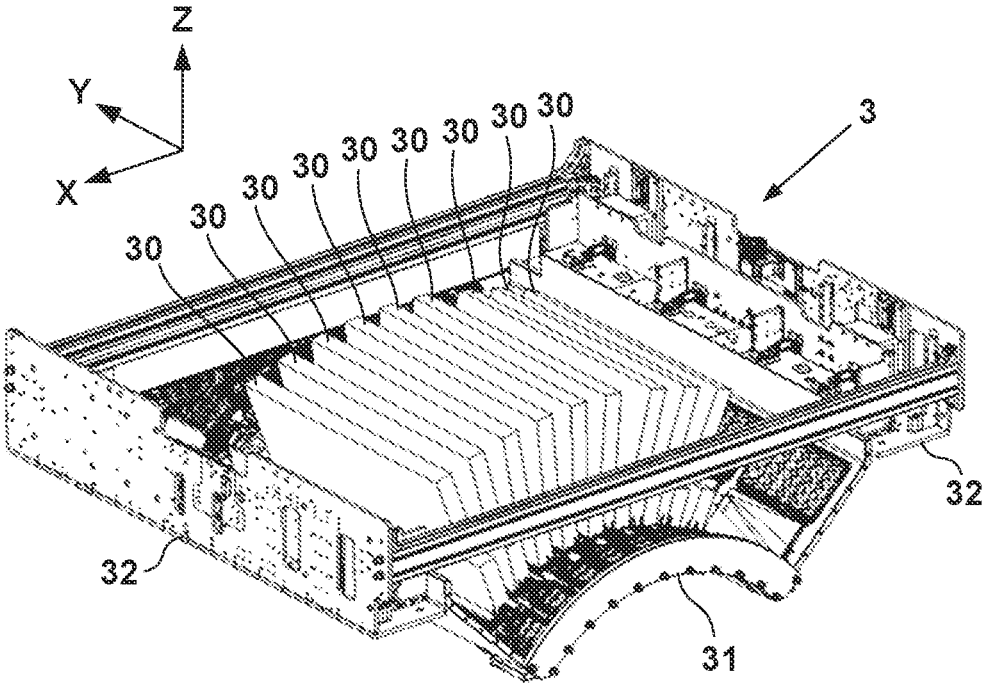
FIG. 2 is a perspective view showing a print unit.

The print unit 3 includes a plurality of printheads 30 and a carriage 31. A description will be made with reference to FIGS. 1 and 2. FIG. 2 is a perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a known inkjet printer is applicable. For example, an element that discharges ink by causing film boiling in ink with an electrothermal transducer and forming a bubble, an element that discharges ink by an electromechanical transducer, an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
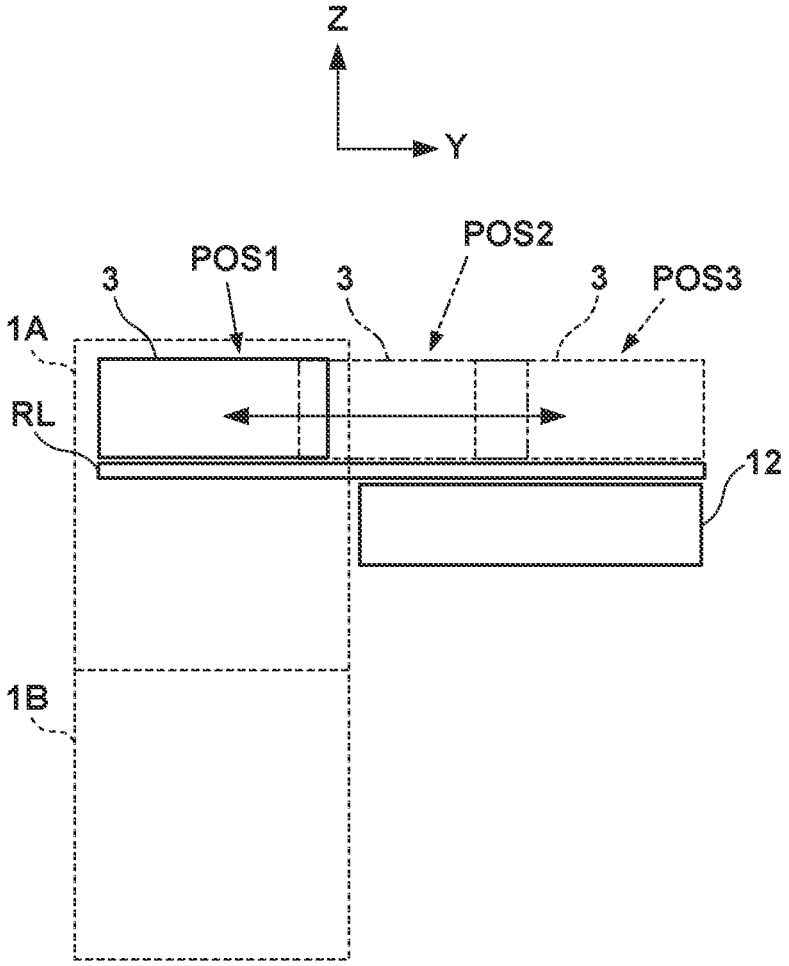
FIG. 3 is an explanatory view showing a displacement mode of the print unit in FIG. 2.

FIG. 3 is a view showing a displacement mode of the print unit 3 and schematically showing the right side surface of the printing system 1. A recovery unit 12 is provided in the rear of the printing system 1. The recovery unit 12 has a function of recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. Thus, the recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum (transfer cylinder) 41 and a pressurizing drum 42. Each of these drums is a rotating member that rotates about a rotation axis in the Y direction and has a cylindrical outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates counterclockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends divided into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative member of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic, can be used appropriately. With respect to durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of these treatments may be combined. It is also possible to provide an arbitrary surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials, such as the resin and the ceramic, can be used appropriately. With respect to processing characteristics, various materials of an elastomer material and a rubber material can be used. More specifically, for example, fluorosilicone rubber, phenyl silicon rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by arbitrarily combining the respective layers formed by the materials described above.

The outer peripheral surface of the pressurizing drum 42 is pressed against the transfer member 2. At least one grip mechanism which holds the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that rotationally drives them. A driving force can be delivered by a transmission mechanism such as a gear mechanism.

<Peripheral Unit>

The peripheral units 5A to 5D are arranged around the transfer drum 41. In this embodiment, the peripheral units 5A to 5D are an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before a transfer operation of transferring the ink image to the print medium. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, or an SEM image observation. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, a dust particle on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, some of these units may each be provided with the cooling function of the transfer member 2 or added with a cooling unit. In this embodiment, the temperature of the transfer member 2 may rise by heat of the heating unit 5C. If the ink image exceeds the boiling point of water as a prime solvent of ink after the print unit 3 discharges ink to the transfer member 2, performance of liquid component absorption by the absorption unit 5B may degrade. It is possible to maintain the performance of liquid component absorption by cooling the transfer member 2 such that the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may include a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image is transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the uppermost conveyance drum 8. Each of the conveyance drums 8 and 8*a* is a rotating member that rotates about the rotation axis in the Y direction and has a cylindrical outer peripheral surface. At least one grip mechanism which holds the leading edge portion of the print medium P (or printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-sided printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. For example, coating for the purpose of protection, improving glossiness, and the like, of an image on the image printed surface of the printed product P' can be used as one type of processing performed by the post processing units 10A and 10B. For example, liquid application, sheet welding, lamination, and the like, can be used as coating contents.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a time-over change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily stopping the run of the chain 8*c*. The inspection unit 9B may be a scanner that scans the printed product P'.

<Control Unit>

Figure 4:
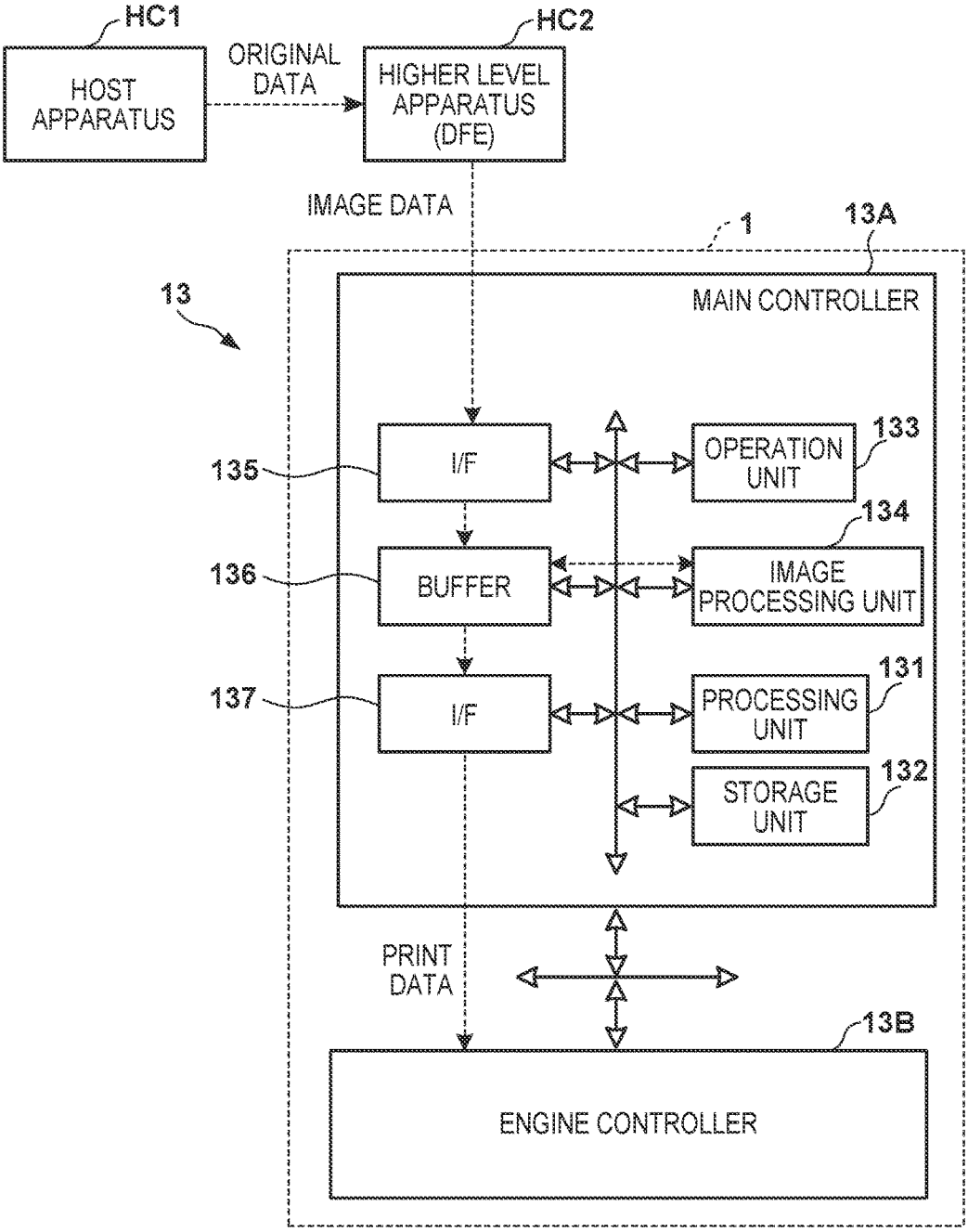
FIG. 4 is a block diagram showing a control system of the printing system in FIG. 1.
Figure 5:
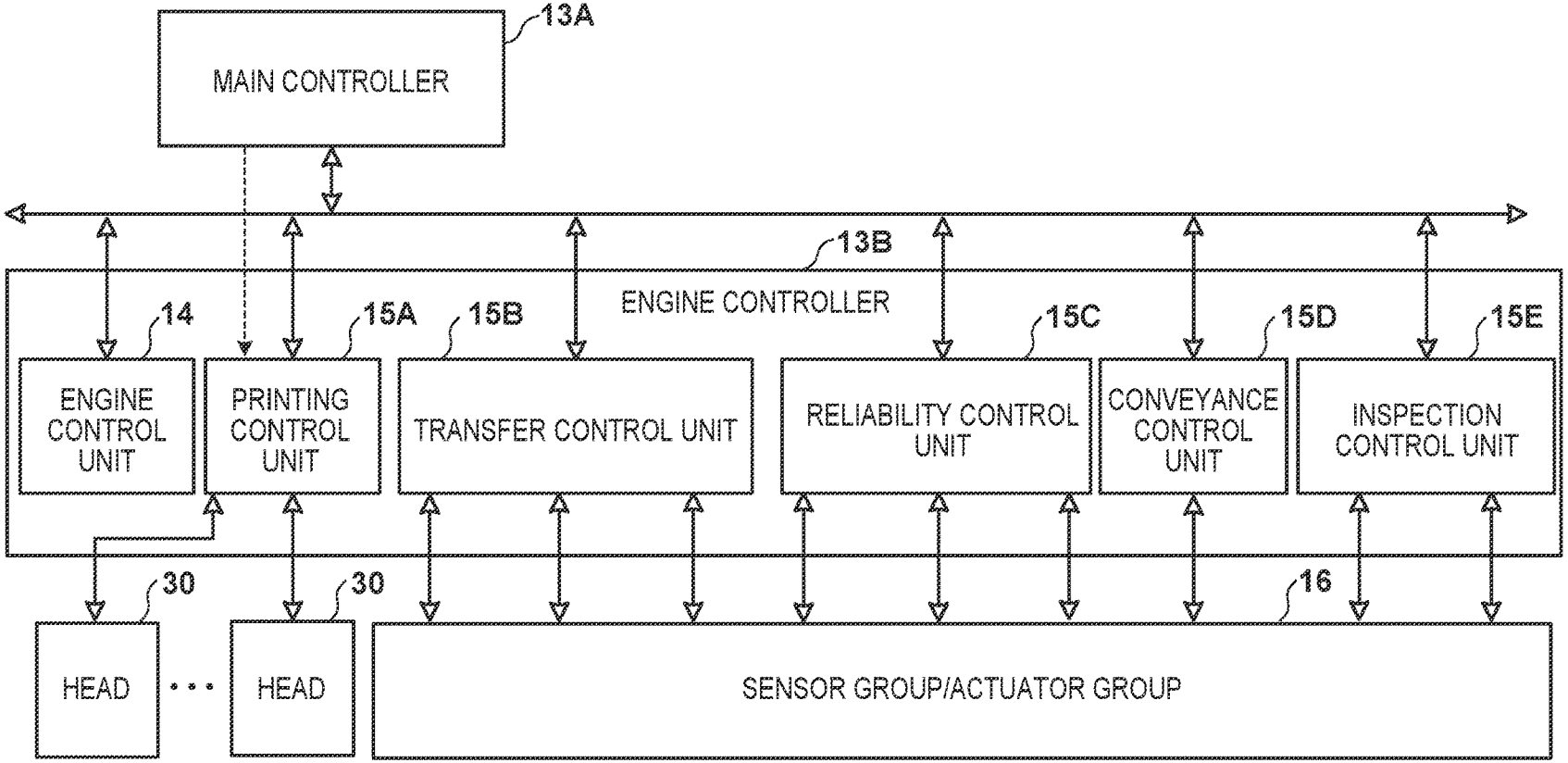
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit 131, and provides the processing unit 131 with a work area. The operation unit 133 is, for example, an input device such as a touch panel, a keyboard, or a mouse and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes control units 14 and 15A to 15E, and acquires a detection result of a sensor group/actuator group 16 of the printing system 1 and performs driving control. Each of these control units includes a processor such as a CPU, a storage device such as a RAM or a ROM, and an interface with an external device. Note that the division of the control units is an example, and a plurality of subdivided control units may perform some of control operations or conversely, the plurality of control units may be integrated with each other, and one control unit may be configured to implement their control contents.

The control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism that moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, and an image sensor. The actuator group includes a motor, an electromagnetic solenoid, and an electromagnetic valve.

<Operation Example>

Figure 6:
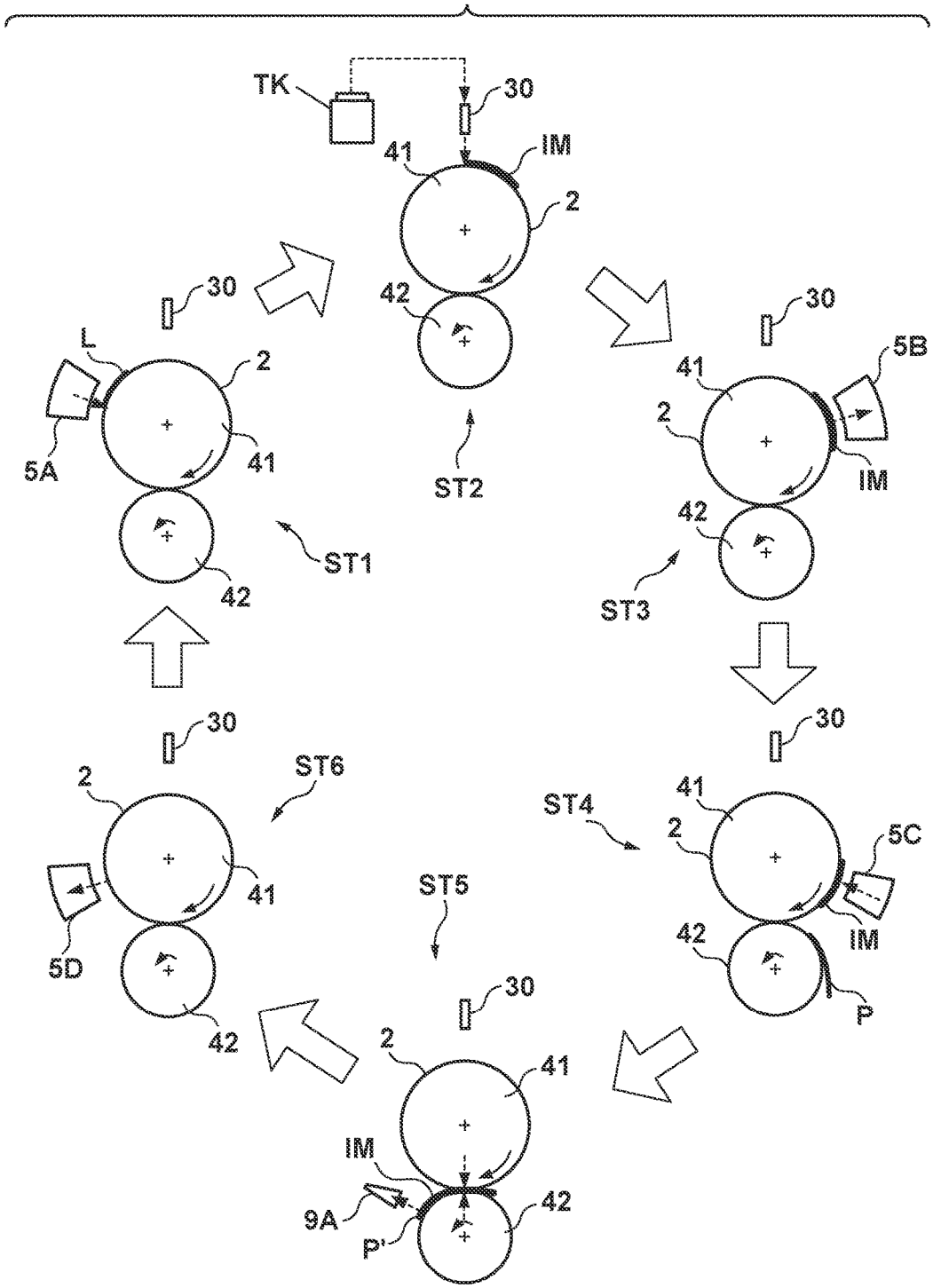
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion, on the transfer member 2, to which the reactive liquid L is applied moves along with the rotation of the transfer drum 41. When the portion to which the reactive liquid L is applied reaches under the printhead 30, ink is discharged from the printhead 30 to the transfer member 2, as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion, on the transfer member 2, where the ink image IM is formed reaches the cleaning unit 5D, it is cleaned by the cleaning unit 5D, as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for easy understanding. It is possible, however, to continuously perform transfer of the ink image IM to the plurality of print media P in one rotation of the transfer member 2.

Figure 7:
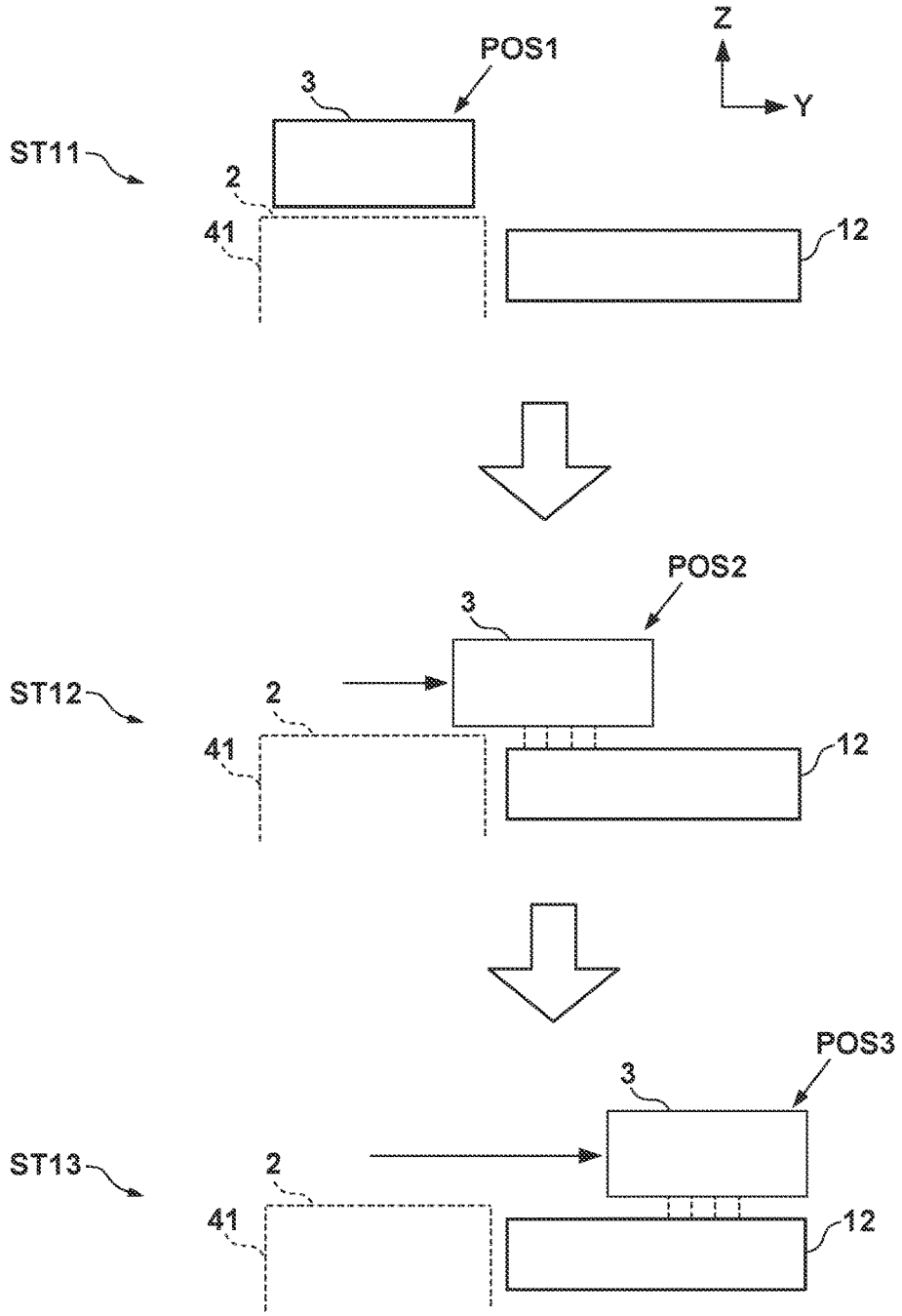
FIG. 7 is an explanatory view showing an example of the operation of the printing system in FIG. 1.

Each printhead 30 needs maintenance if such a printing operation continues. FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

<Absorption Unit>

Figure 8:
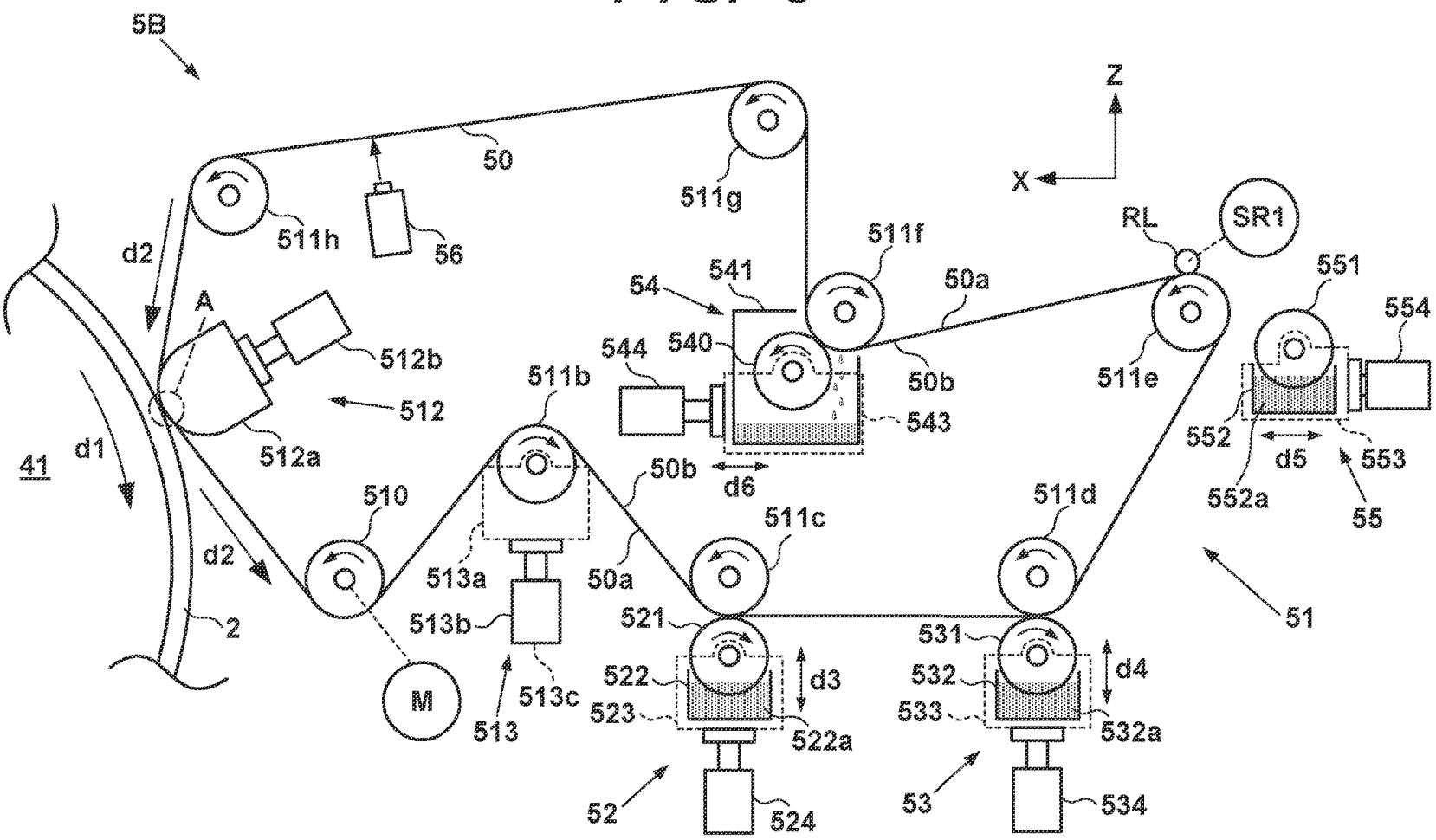
FIG. 8 is a schematic view showing an absorption unit.

A detailed example of the absorption unit 5B will be described with reference to FIG. 8. FIG. 8 is a schematic view showing an example of the absorption unit 5B. The absorption unit 5B is a liquid absorbing apparatus that absorbs a liquid component from the ink image IM formed on the transfer member 2 before the ink image IM is transferred to the print medium P. When the water-soluble pigment ink is used as in this embodiment, the absorption unit 5B mainly aims at absorbing moisture in the ink image. This makes it possible to suppress occurrence of a curl or cockling of the print medium P.

The absorption unit 5B includes a liquid absorbing member 50, a driving unit 51 that cyclically moves the liquid absorbing member 50, a displacing unit 512, a plurality of kinds of recovery units 52 to 54, a preprocessing unit 55, and a detection unit 56.

The liquid absorbing member 50 is an absorber that absorbs the liquid component from the ink image IM and is a liquid absorbing sheet formed into an endless belt in the example of FIG. 8. A liquid absorbing position A is a position where the liquid absorbing member 50 absorbs the liquid component from the ink image IM on the transfer member 2 and indicates a portion where the liquid absorbing member 50 gets closest to the transfer member 2. An arrow d1 indicates a moving direction of the transfer member 2, and an arrow d2 indicates a moving direction of the liquid absorbing member 50.

The liquid absorbing member 50 may be formed by a single layer but may be formed by multiple layers. A double layer structure of an obverse layer and a reverse layer is exemplified here. The obverse layer forms a first surface 50*a* contacting the ink image IM, and the reverse layer forms a second surface 50*b*. The liquid absorbing member 50 absorbs the liquid component of the ink image IM on the transfer member 2. The liquid component of the ink image IM penetrates from the obverse layer into the liquid absorbing member 50 and further penetrates into the reverse layer. The ink image IM serves as the ink image IM with a decreased liquid component to move toward the heating unit 5C.

Each of the obverse layer and the reverse layer can be made of a porous material. The average pore size of the reverse layer can be made larger than that of the obverse layer in order to increase absorption performance of the liquid component while suppressing adherence of the coloring material. This makes it possible to promote movement of the liquid component from the obverse layer to the reverse layer.

A material for the obverse layer may be, for example, a hydrophilic material whose contact angle with respect to water is less than 90° or a water-repellent material whose contact angle with respect to water is 90° or more. For the hydrophilic material, the material may have the contact angle with respect to water to be 40° or less. The contact angle may be measured complying with a technique described in, for example, "6. static method" of JIS R3257.

The hydrophilic material has an effect of drawing up a liquid by a capillary force. Cellulose, polyacrylamide, or a composite material of these can be given as the hydrophilic material. When the water-repellent material is used, a hydrophilic treatment may be performed on its surface. A method such as sputter etching can be given as the hydrophilic treatment.

For example, a fluorine resin can be given as the water-repellent material. For example, polytetrafluoroethylene, polychlorotrifluoroethylene, polyvinylidene fluoride, or the like can be given as the fluorine resin. A time may be taken until the effect of drawing up the liquid is exerted when the water-repellent material is used for the obverse layer. To cope with this, a liquid whose contact angle with the obverse layer is less than 90° may be impregnated into the obverse layer.

For example, resin-fiber nonwoven fabric or woven fabric can be given as a material for the reverse layer. The material for the reverse layer may have the contact angle of water equal to or larger than that for the obverse layer because the liquid component does not flow backward from the reverse layer to the obverse layer. For example, polyolefin, polyurethane, polyamide such as nylon, polyester, polysulfone, or a composite material of these can be given as the material for the reverse layer.

For example, adhesive lamination, thermal lamination, or the like can be given as a laminating method of the obverse layer and the reverse layer.

The driving unit 51 is a mechanism which supports the liquid absorbing member 50 such that it can rotate and move cyclically so as to pass through the liquid absorbing position A, and includes a drive rotating body 510 and a plurality of driven rotating bodies 511*b* to 511*h*. The drive rotating body 510 and the driven rotating bodies 511 are rollers or pulleys around which the swath liquid absorbing member 50 is wound and are supported rotatably about an axis in the Y direction.

The drive rotating body 510 is a conveyance rotating body such as a conveyance roller that rotates by a driving force of a motor M, and rotates and moves the liquid absorbing member 50. The driven rotating bodies 511*b* to 511*h* are supported freely rotatably. In this embodiment, these drive rotating body 510 and driven rotating bodies 511*b* to 511*h* define a rotating and moving path of the liquid absorbing member 50. The rotating and moving path of the liquid absorbing member 50 is a zigzag path winding up and down when viewed from a rotating and moving direction (arrow d2). This makes it possible to use the longer liquid absorbing member 50 in a smaller space and decrease a replacement frequency upon performance deterioration in the liquid absorbing member 50.

The driven rotating body 511*b* includes a tension adjustment mechanism 513. The tension adjustment mechanism 513 is a mechanism which adjusts the tension of the liquid absorbing member 50 and includes a support member 513*a*, a moving mechanism 513*b*, and a sensor 513*c*. The support member 513*a* supports the driven rotating body 511*b* rotatably about the axis in the Y direction. The moving mechanism 513*b* is a mechanism which moves the support member 513*a* and is, for example, an electrically-driven cylinder. The moving mechanism 513*b* can displace the position of the driven rotating body 511*b*, adjusting the tension of the liquid absorbing member 50. The sensor 513*c* detects the tension of the liquid absorbing member 50. In this embodiment, the sensor 513*c* detects a load received by the moving mechanism 513*b*. The tension of the liquid absorbing member 50 can be controlled automatically by controlling the moving mechanism 513*b* based on a detection result of the sensor 513*c*.

The displacing unit 512 is a mechanism which displaces the liquid absorbing member 50 between a contact state in which the liquid absorbing member 50 contacts the transfer member 2 and a retracted state in which the liquid absorbing member 50 is separated from the transfer member 2. In this embodiment, the displacing unit 512 acts on a part of the liquid absorbing member 50, and displaces the liquid absorbing member 50 between a state in which the part contacts the transfer member and a state in which the part is separated from the transfer member. However, the displacing unit 512 may move the liquid absorbing member 50 as a unit.

The displacing unit 512 includes a movable member 512*a* and a pressing mechanism 512*b*. The movable member 512*a* is arranged facing the transfer member 2 and has a peripheral surface where the liquid absorbing member 50 slidably moves. The pressing mechanism 512*b* is a mechanism which moves the movable member 512*a* forward/backward with respect to the transfer member 2, and is, for example, an electrically-driven cylinder. The part of the liquid absorbing member is pressed against the transfer member 2 via the movable member 512*a* by driving the pressing mechanism 512*b*.

Figure 9A:
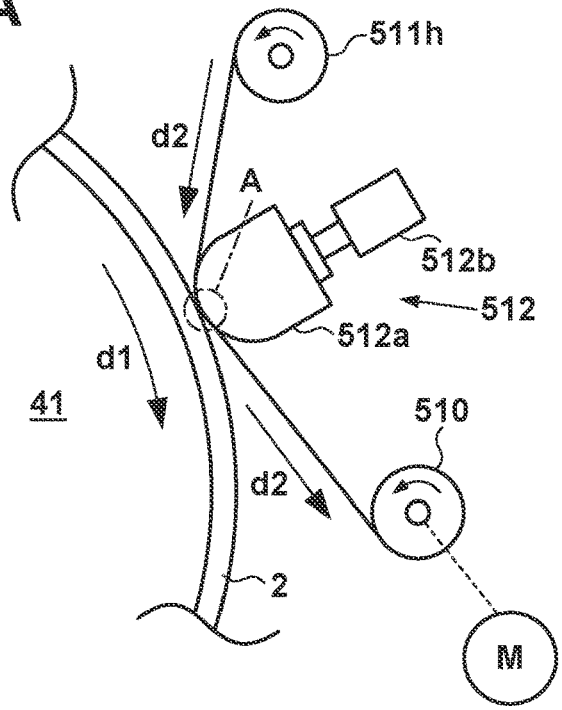
FIGS. 9A and 9B are explanatory views showing the operation of a displacing unit.
Figure 9B:
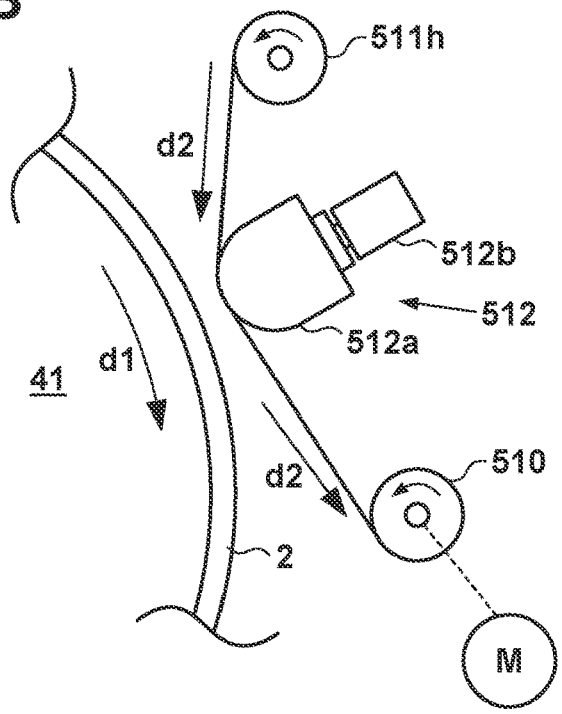

FIGS. 9A and 9B are explanatory views showing the operation of the displacing unit 512. FIG. 9A shows a state in which the liquid absorbing member 50 is displaced to the contact state. FIG. 9B shows a state in which the liquid absorbing member 50 is displaced to the retracted state.

When the liquid absorbing member 50 is displaced to the contact state, the liquid absorbing member 50 and the transfer member 2 contact each other at the liquid absorbing position A. At the liquid absorbing position A, the liquid absorbing member 50 is sandwiched between the transfer member 2 and the movable member 512*a*. The liquid absorbing member 50 is advantageously pressed against the transfer member 2 in terms of liquid absorption efficiency. During a printing operation, the driving unit 51 controls the liquid absorbing member 50 so that a rotating and moving speed of the liquid absorbing member 50 becomes equal to a peripheral speed of the transfer member 2. This prevents friction between the liquid absorbing member 50 and the transfer member 2 or the ink image IM.

The retracted state can be at a position where the liquid absorbing member 50 can be separated from the transfer member 2, and a distance between the contact state and the retracted state can be short. A direction in which the part of the liquid absorbing member 50 moves between the contact state and the retracted state, that is, the pressing/releasing direction of the pressing mechanism 512*b* is a direction crossing the tangential direction of the transfer member 2 at the liquid absorbing position A and is, for example, a perpendicular direction.

The liquid absorbing member 50 is arranged to contact or separate from the transfer member 2 freely by providing the displacing unit 512, making it easier to perform a maintenance operation or warm-up of the transfer member 2 and liquid absorbing member 50 individually.

Referring back to FIG. 8, a sensor SR1 detects a rotating and moving speed or rotating and moving amount of the liquid absorbing member 50. The sensor SR1 is, for example, a rotary encoder. In this embodiment, a rotating body RL of the sensor SR1 contacts the liquid absorbing member 50, rotates in accordance with rotation and movement of the liquid absorbing member 50, and detects its rotation amount. The rotating body RL is arranged facing the driven rotating body 511*e*. The rotating and moving speed or rotating and moving amount of the liquid absorbing member 50 can also be specified by detecting and calculating the rotation speed of the drive rotating body 510 or those of the driven rotating bodies 511*b* to 511*h*. However, the liquid absorbing member 50 may slip with respect to these rotating bodies, and thus a value different from an actual moving speed of the liquid absorbing member 50 may be obtained.

The detection unit 56 is a sensor that detects passage of a predetermined portion of the liquid absorbing member 50 at a predetermined position on the moving path of the liquid absorbing member 50. For example, the liquid absorbing member 50 is provided with a marker, and the detection unit 56 is a sensor that detects this marker. A marker 50*d* is, for example, a marker different in color from another portion of the liquid absorbing member 50 (for example, the liquid absorbing member 50 is white, and the marker 50*d* is black). The detection unit 56 is, for example, a reflective photosensor. The detection unit 56 detects the marker, and the sensor SR1 detects the moving amount of the liquid absorbing member 50, making it possible to recognize the portion of the liquid absorbing member 50 that passes through the liquid absorbing position A, the circulation count of the liquid absorbing member 50, and the like.

The cleaning unit 52, the application unit 53, and the collection unit 54 are apparatuses that recover the liquid absorption performance of the liquid absorbing member 50. By providing such recovery mechanisms, it is possible to suppress the performance deterioration in the liquid absorbing member 50 and maintain the liquid absorption performance for a longer time. This makes it possible to decrease the replacement frequency of the liquid absorbing member 50.

In this embodiment, the three kinds of recovery units 52 to 54 different in function are arranged in the middle of the moving path of the liquid absorbing member 50. However, configuration may be taken to provide only one recovery unit. Alternatively, a plurality of recovery units having a common function may be provided.

The cleaning unit 52 and the application unit 53 perform processes on the first surface 50*a*, and the collection unit 54 performs a process on the second surface 50*b*. By performing the different processes for the first surface 50*a* and the second surface 50*b*, it is possible to recover the liquid absorption performance of the liquid absorbing member 50 more properly.

The cleaning unit 52 is an apparatus that cleans the liquid absorbing member 50. The cleaning unit 52 includes a cleaning roller 521, a reservoir 522, a support member 523, and a moving mechanism 524. The support member 523 supports the cleaning roller 521 rotatably about the axis in the Y direction and also supports the reservoir 522. A cleaning liquid 522*a* is reserved in the reservoir 522. The cleaning roller 521 is partially immersed in the cleaning liquid 522*a*. The moving mechanism 524 is a mechanism which moves the support member 523 and is, for example, an electrically-driven cylinder. The cleaning roller 521 and the reservoir 522 also move when the support member 523 moves. They move in the direction of an arrow d3 (here, the vertical direction) between a cleaning position at which the cleaning roller 521 contacts the liquid absorbing member 50 and a retracted position at which the cleaning roller 521 is separated from the liquid absorbing member 50. FIG. 8 shows a state in which the cleaning roller 521 is positioned at the cleaning position (a state during a recovery operation). The cleaning roller 521 may be positioned at the cleaning position during the operation of the printing system 1 and may move to the retracted position at the time of maintenance.

The cleaning roller 521 is arranged facing the driven rotating body 511*c*. The liquid absorbing member 50 is configured to be nipped by the cleaning roller 521 and the driven rotating body 511*c* when the cleaning roller 521 moves to the cleaning position. The cleaning roller 521 rotates in accordance with rotation and movement of the liquid absorbing member 50. The peripheral surface of the cleaning roller 521 is formed by, for example, a cohesive material and removes a dust particle (paper dust or the like) adhered to the first surface 50*a* of the liquid absorbing member 50 by contacting the first surface 50*a*. For example, rubber of butyl, silicone, urethan, or the like can be given as a material for the peripheral surface of the cleaning roller 521. The cleaning liquid 522*a* is, for example, a surfactant and can use a liquid that promotes separation of a dust particle adhered to the cleaning roller 521. The reservoir 522 may include a wiper that promotes separation of a dust particle by contacting the surface of the cleaning roller 521. Furthermore, a roller that is higher in viscosity than the cleaning roller 521 and takes out the dust particle from the cleaning roller 521 may be arranged in the reservoir 522.

In this embodiment, an arrangement that removes the dust particle adhered to the first surface 50*a* of the liquid absorbing member 50 by the cleaning roller 521 is adopted. However, another arrangement such as an arrangement that removes the dust particle by blowing air can also be adopted.

The application unit 53 is an apparatus that applies a moisturizing liquid to the liquid absorbing member 50. The application unit 53 includes an application roller 531, a reservoir 532, a support member 533, and a moving mechanism 534. The support member 533 supports the application roller 531 rotatably about the axis in the Y direction and also supports the reservoir 532. A moisturizing liquid 532*a* is reserved in the reservoir 532. The application roller 531 is partially immersed in the moisturizing liquid 532*a*. The moving mechanism 534 is a mechanism which moves the support member 533 and is, for example, an electrically-driven cylinder. The application roller 531 and the reservoir 532 also move when the support member 533 moves. They move in the direction of an arrow d4 (here, the vertical direction) between an application position at which the application roller 531 contacts the liquid absorbing member 50 and a retracted position at which the application roller 531 is separated from the liquid absorbing member 50. FIG. 8 shows a state in which the application roller 531 is positioned at the application position (a state during the recovery operation). The application roller 531 may be positioned at the application position during the operation of the printing system 1 and may move to the retracted position at the time of maintenance.

The application roller 531 is arranged facing the driven rotating body 511*d*. The liquid absorbing member 50 is configured to be nipped by the application roller 531 and the driven rotating body 511*d* when the application roller 531 moves to the application position. The application roller 531 rotates in accordance with rotation and movement of the liquid absorbing member 50. The peripheral surface of the application roller 531 is formed by, for example, rubber and supplies the moisturizing liquid 532*a* reserved in the reservoir 532 to the first surface 50*a* of the liquid absorbing member 50 by drawing the moisturizing liquid 532*a*. The moisturizing liquid 532*a* is, for example, water. The moisturizing liquid 532*a* may contain a water-soluble organic solvent or a surfactant.

The first surface 50*a* may be thickened by using the liquid absorbing member 50, and this may degrade absorption performance of the liquid component from the ink image IM. It is possible to suppress thickening of the first surface 50*a* and maintain the absorption performance of the liquid component by applying the moisturizing liquid 532*a* to the first surface 50*a*.

In this embodiment, an arrangement that draws the moisturizing liquid 532*a* to the first surface 50*a* of the liquid absorbing member 50 by the application roller 531 is adopted. However, another arrangement such as an arrangement that sprays the moisturizing liquid 532*a* to the first surface 50*a* by a nozzle can also be adopted.

The collection unit 54 is an apparatus that removes the liquid component from the liquid absorbing member 50. The collection unit 54 includes a removing roller 540, a reservoir 541 that stores the removed liquid component, a support member 543, and a moving mechanism 544. The support member 543 supports the removing roller 540 rotatably about the axis in the Y direction and also supports the reservoir 541. The moving mechanism 544 is a mechanism which moves the support member 543 and is, for example, an electrically-driven cylinder. The removing roller 540 and the reservoir 541 also move together with the support member 543. They are moved in the direction of an arrow d6 (here, the horizontal direction) between a removal position at which the removing roller 540 contacts the liquid absorbing member 50 and a retracted position at which the removing roller 540 is separated from the liquid absorbing member 50. FIG. 8 shows a state in which the removing roller 540 is positioned at the removal position (a state during a recovery operation). The removing roller 540 is configured to be positioned at the removal position during the operation of the printing system 1, and to move to the retracted position at the time of maintenance.

The removing roller 540 is arranged facing the driven rotating body 511*f*. The liquid absorbing member 50 is configured to be nipped by the removing roller 540 and the driven rotating body 511*f* when the removing roller 540 moves to the removal position. The removing roller 540 rotates in accordance with rotation and movement of the liquid absorbing member 50. The liquid absorbing member 50 is sandwiched between the removing roller 540 and the driven rotating body 511*f*, squeezing out the liquid component absorbed by the liquid absorbing member 50. In that sense, the driven rotating body 511*f* commonly uses a part of the collection unit 54.

In the collection unit 54, the second surface 50*b* of the liquid absorbing member 50 is positioned on the lower side in a gravity direction, and the first surface 50*a* is positioned on the upper side in the gravity direction. Therefore, it is more likely that the liquid component is squeezed out of the side of the second surface 50*b* than of the side of the first surface 50*a* and falls due to gravity. It is possible to ensure an area for absorbing the liquid component in the reverse layer and recover the liquid absorption performance of the liquid absorbing member 50 by promoting removal of the liquid component from the second surface 50*b*. It is also possible to suppress drying of the first surface 50*a* to which the moisturizing liquid is applied by the application unit 53.

As described above, in this embodiment, an arrangement is adopted in which the cleaning unit 52, the application unit 53, and the collection unit 54 perform recovery processing in the processing order of the removal of the dust particle, moisturizing, and the removal of the liquid component from an upstream side to a downstream side in the rotating and moving direction of the liquid absorbing member 50. The processing order is not limited to this. According to the processing order of this embodiment, however, the application unit 53 moisturizes the first surface 50*a* after the cleaning unit 52 cleans the first surface 50*a*, making it possible to promote the removal of the dust particle and an improvement in moisture retention. Moreover, the collection unit 54 removes the liquid component relatively on the downstream side, making it possible to remove the liquid component in a place where the second surface 50*b* moves at a high position in the vertical direction. This has the advantage that the removed liquid component is easily collected by using gravity.

Note that in each of the above-described recovery units 52 to 54, a support member that supports the driven rotating body 511 and a moving mechanism that moves the support member may be prepared. In this case, the liquid absorbing member 50 can be configured to be pressed against the cleaning roller 521, the application roller 531, and the removing roller 540 by moving the driven rotating bodies 511.

The preprocessing unit 55 will be described next. The preprocessing unit 55 is an apparatus that mainly performs preprocessing for making full use of the liquid absorption performance of the liquid absorbing member 50 in a short time at the start of the operation of the printing system 1 or the like. In this embodiment, a preprocessing liquid is applied to the first surface 50*a* of the liquid absorbing member 50, improving a rise in liquid absorption performance. For example, when an obverse layer 501 is made of the water-repellent material, the preprocessing liquid can use a surfactant. F-444 (trade name, available from DIC), ZonylFS3100 (trade name, available from DuPont), or CapstoneFS-3100 (trade name, available from The Chemours Company LLC) of a fluorochemical surfactant is given as the surfactant. BYK349 (trade name, available from BYK) of a silicone-based surfactant or the like may also be used.

The preprocessing unit 55 includes an application roller 551, a reservoir 552, a support member 553, and a moving mechanism 554. The support member 553 supports the application roller 551 rotatably about the axis in the Y direction and also supports the reservoir 552. A preprocessing liquid 552*a* is reserved in the reservoir 552. The application roller 551 is partially immersed in the preprocessing liquid 552*a*. The moving mechanism 554 is a mechanism which moves the support member 553 and is, for example, an electrically-driven cylinder. The application roller 551 and the reservoir 552 also move when the support member 553 moves. They are moved in the direction of an arrow d5 (here, the horizontal direction) between an application position at which the application roller 551 contacts the liquid absorbing member 50 and a retracted position at which the application roller 551 is separated from the liquid absorbing member 50. FIG. 8 shows a state in which the application roller 551 is positioned at the retracted position. The application roller 551 can move to the application position at the start of the operation of the printing system 1 or periodically (for example, in the unit of the number of print media P to be processed).

The application roller 551 is arranged facing the driven rotating body 511*e*. The liquid absorbing member 50 is configured to be nipped by the application roller 551 and the driven rotating body 511*e* when the application roller 551 moves to the application position. The application roller 551 rotates in accordance with rotation and movement of the liquid absorbing member 50. The peripheral surface of the application roller 551 is formed by, for example, rubber and supplies the preprocessing liquid 552*a* reserved in the reservoir 552 to the first surface 50*a* of the liquid absorbing member 50 by drawing the preprocessing liquid 552*a*.

The cleaning roller 521 and driven rotating body 511*c*, the application roller 531 and driven rotating body 511*d*, the removing roller 540 and driven rotating body 511*f*, and the application roller 551 and driven rotating body 511*e* are formed by members having a predetermined structure strength to obtain sufficient durability. The material of each member is, for example, rubber, a metal, ceramic, a resin, or the like. In an example, silicone, EPDM, urethane, aluminum, iron, stainless steel, an acetal resin, an epoxy resin, polyimide, polyethylene, polyethylene terephthalate, nylon, polyurethane, silica ceramic, or alumina ceramic can be used. Note that a combination thereof may be used.

In an example, the removing roller 540 and the driven rotating body 511*f* nip the liquid absorbing member 50 with a nipping pressure of 1.5 kgf/cm$^2$ or higher, squeezing the liquid component. Note that the nipping pressure indicates the nipping pressure between the liquid absorbing member 50 and the removing roller 540 and driven rotating body 511*f*. Furthermore, an action time during which the removing roller 540 and the driven rotating body 511*f* are made to act on the liquid absorbing member 50 is, for example, 2 ms or longer, making it possible to collect the liquid component from the liquid absorbing member 50 stably. In an example, the cleaning roller 521 and the driven rotating body 511*c* nip the liquid absorbing member 50 with a nipping pressure of 0.2 kgf/cm$^2$ or higher, cleaning the liquid absorbing member 50. Furthermore, an action time during which the cleaning roller 521 and the driven rotating body 511*c* are made to act on the liquid absorbing member 50 is, for example, 2 ms or longer, making it possible to remove a stain from the liquid absorbing member 50 stably. Similarly, in an example, the application roller 531 and driven rotating body 511*d* or the application roller 551 and driven rotating body 511*e* can be configured to nip the liquid absorbing member 50 with a nipping pressure of 0.2 kgf/cm$^2$ or higher and obtain an action time of 2 ms or longer. Note that the value of the nipping pressure can be calculated by measuring a contact pressure by a pressure pattern measuring device and dividing a load in a nipping area by an area where the pressure is detected. The action time is calculated by dividing, by the moving speed of the porous body, a pressure detection width in the moving direction of the liquid absorbing member 50 in contact pressure measurement.

With this arrangement, the absorption unit 5B causes the liquid absorbing member 50 to remove the liquid component from the ink image IM on the transfer member 2. When the liquid component is removed simultaneously with the cyclic movement of the liquid absorbing member 50, it is possible to remove the liquid component from the ink image IM continuously, and remove the liquid component without replacing the liquid absorbing member 50 during a predetermined operating period. In addition, since the recovery units 52 to 54 are provided, the liquid absorption performance of the liquid absorbing member 50 can be maintained for a longer period, making it possible to further prolong the replacement cycle of the liquid absorbing member 50. Note that the recovery units 52 to 54 can perform recovery operations during a printing operation, and also perform recovery operations while positioning the liquid absorbing member 50 at the retracted position by the displacing unit 512 and circulating the liquid absorbing member 50 by the driving unit 51.

As described above, the absorption unit 5B includes a plurality of portions where the liquid absorbing member 50 is nipped. In this case, the nipping pressure of the removing roller 540 and the driven rotating body 511*f* is set so as to sufficiently remove the liquid component from the liquid absorbing member 50. However, if the nipping pressure of another nipping portion is high, the liquid component is unwantedly squeezed in that portion. That is, the liquid component is squeezed at a position different from the collection unit 54, causing liquid leakage in the apparatus. To solve this problem, in this embodiment, the nipping pressures in the nipping portions other than the removing roller 540 and the driven rotating body 511*f* are set lower than at least the nipping pressure of the removing roller 540 and the driven rotating body 511*f*. This can prevent liquid leakage in the apparatus. Examples of the relationship between some settings of such arrangement and a result obtained by an experiment using the settings will be described below.

Settings of the experiment as a premise will be described first. Note that in the following description, a "part" is a mass standard unless otherwise specified.

<Preparation of Reactive Liquid>

As the reactive liquid applied by the peripheral unit 5A, a reactive liquid having the following composition was used. Note that the "balance" of ion-exchanged water indicates an amount when the total of all components that constitute the reactive liquid becomes 100.0 mass % (the same shall apply hereafter).

| | |
|---|---|
| glutaric acid | 21.0 mass % |
| glycerine | 5.0 mass % |

-continued

| | |
|---|---|
| surfactant (trade name: MEGAFACE F-444, available from DIC)) | 5.0 mass % |
| ion-exchanged water | balance |

<Preparation of Ink>

Ink was prepared by mixing a black pigment dispersion and a resin particle dispersion (both of which will be described later) with the following components.

| | |
|---|---|
| pigment dispersion (the content of a coloring material is 10.0 mass %) | 40.0 mass % |
| resin particle dispersion | 20.0 mass % |
| glycerine | 7.0 mass % |
| polyethylene glycol (number average molecular weight (Mn): 1,000) | 3.0 mass % |
| surfactant: Acetylenol E100 (available from Kawaken Fine Chemicals) | 0.5 mass % |
| ion-exchanged water | balance |

After the above components were stirred and dispersed sufficiently, pressure filtration was performed in a microfilter (available from Fujifilm) having a pore size of 3.0 μm, preparing black ink.

<<Preparation of Pigment Dispersion>>

10 parts of carbon black, 15 parts of a resin aqueous solution (obtained by neutralizing an aqueous solution containing a styrene-ethyl acrylate-acrylic acid copolymer, and having an acid number of 150, a weight-average molecular weight (Mw) of 8,000, and a resin content of 20.0 mass % with a potassium hydroxide aqueous solution), and 75 parts of pure water were mixed. Note that as the carbon black, MONARCH 1100 (trade name, available from CABOT) was used. A dispersion treatment was performed for 5 hrs while changing this mixture into a batch vertical sand mill (available from AIMEX), filling it with 200 parts of zirconia beads with a diameter of 0.3 mm, and cooling it with water. This dispersion liquid was centrifuged, and coarse particles were removed, obtaining a black pigment dispersion having a pigment content of 10.0 mass %.

<<Preparation of Resin Particle Dispersion>>

20 parts of ethyl methacrylate, 3 parts of 2,2'-azobis-(2-methylbutyronitrile), and 2 parts of n-hexadecane were mixed and stirred for 0.5 hrs. This mixture was dripped to 75 parts of an 8 mass % aqueous solution of a styrene-butyl acrylate-acrylic acid copolymer (acid number: 130 mgKOH/g, weight-average molecular weight (Mw): 7,000) and stirred for 0.5 hrs. Next, ultrasonic irradiation was performed for 3 hrs by an ultrasonic irradiator. Subsequently, a polymerization reaction was performed at 80° C. for 4 hrs in a nitrogen atmosphere, and filtration was performed after cooling to room temperature, preparing a resin particle dispersion having a resin content of 25.0 mass %.

<Inkjet Printing Apparatus and Image Formation>

In the printing system 1 shown in FIG. 1, the transfer member 2 is fixed to the transfer drum 41 by a double-sided adhesive tape. As the elastic layer of the transfer member 2, a sheet obtained by coating a PET sheet with a thickness of 0.5 mm with silicone rubber (KE12: trade name, available from Shin-Etsu Chemical) with a thickness of 0.3 mm was used. Furthermore, a mixture of a photocationic polymerization initiator (trade name: SP150, available from ADEKA) and a condensate obtained by mixing glycidoxypropyltriethoxysilane and methyltriethoxysilane at a molar ratio of 1:1 and heating and refluxing the mixture was prepared. Atmospheric pressure plasma processing was performed to obtain 10° or less as the contact angle of the surface of the elastic layer with respect to water. After that, the above-described mixture was applied onto the elastic layer, a film is formed by UV irradiation (a high-pressure mercury lamp, an accumulated exposure amount of 5,000 mJ/cm$^2$) and heat curing (at 150° C. for 2 hrs), producing the transfer member 2 with the surface layer having a thickness of 0.5 μm and formed on the elastic layer. Note that the surface of the transfer member 2 was maintained at 60° C. by a heating unit (not shown).

The application amount of the above-described reactive liquid applied by the application unit 5A was 1 g/m$^2$. As the printhead 30, an inkjet printhead that discharges ink by an on-demand method using an electrothermal transducer was used. The application amount of ink in image formation was 20 g/m$^2$.

The rotating and moving speed of the liquid absorbing member 50 was adjusted by the drive rotating body 510 to be equal to the moving speed of the transfer member 2. In addition, the conveyance apparatus 1B conveyed the print medium at a speed equal to the moving speed of the transfer member 2. The conveyance speed of the print medium was set to 0.2 m/s. As the print medium, aurora coated paper (available from Nippon Paper Group, a grammage of 104 g/m$^2$) was used.

As the liquid absorbing member 50, an endless liquid absorbing sheet made of a porous material formed from two layers, that is, an obverse layer and a reverse layer was used. For the obverse layer contacting the ink image, a stretch film made of PTFE (polytetrafluoroethylene) having a pore size of 0.2 μm and a thickness of 10 μm was used. For the reverse layer, nonwoven fabric made of a PET material having a pore size of 20 μm and a thickness of 190 μm was used. Then, a body obtained by integrating these two layers with heat pressure lamination was used as the above-described porous material. When IPA (isopropyl alcohol) is permeated through the porous material at a differential pressure of 0.1 MPa, a flow rate per unit area (1 cm$^2$) was 4 ml/min/cm$^2$. A Gurley value G1 of the porous material defined by JIS P8117 was 8 s. Table 1 collectively shows the arrangement and physical properties of the porous material. Note that as preprocessing, the liquid absorbing member 50 was immersed in a processing liquid containing 95 parts of ethanol and 5 parts of water, the processing liquid penetrated, and the processing liquid was substituted by water.

TABLE 1

| Porous Material | | | | | |
|---|---|---|---|---|---|
| Material | Thickness | Porosity | Average Pore Size | Compressive Modulus | Gurley Value |
| PTFE | 30 μm | 80% | 3 μm | 1.5 | 3.0 |

<Evaluation>

After removing the liquid from the ink image using the above arrangement, the liquid component was collected from the liquid absorbing member 50 on the transfer drum 41, and liquid leakage and a liquid collection rate were evaluated based on criteria (to be described later). Note that an example in which the cleaning unit 52 (cleaning roller 521 and driven rotating body 511*c*) was used as a nipping portion other than the collection unit 54 will be described below. However, in addition to the cleaning unit 52, the nipping pressure by the application unit 53 or the preprocessing unit 55 can also be treated, similarly to the cleaning unit 52. Note that in the following example, the liquid absorbing member 50 is not nipped by the application unit 53 or the preprocessing unit 55.

In this evaluation processing, the weight of a leaked liquid was calculated from a change in weight of the liquid absorbing member 50 before and after execution of the cleaning step by the cleaning unit 52 by repeatedly absorbing the liquid from the image by the liquid absorbing member 50. Assuming that the mass of the liquid absorbing member 50 after absorbing the liquid from the ink image was W1 (mg) and the mass of the liquid absorbing member 50 after passing through the nipping portion by the cleaning unit 52 or the like was W2 (mg), a liquid leakage rate was calculated by:

$$\text{liquid leakage rate (\%)}=\{(W1-W2)/W1\}\times 100$$

A liquid collection amount was calculated from a change in weight of the liquid absorbing member 50 before and after execution of the liquid absorption step by the collection unit 54. In the liquid absorption step, assuming that the mass of the liquid absorbing member 50 after absorbing the liquid from the image (before the liquid absorption step) was W3 (mg) and the mass of the liquid absorbing member 50 after liquid collection was W4 (mg), the collection rate was calculated by:

$$\text{collection rate (\%)}=\{(W3-W4)/W3\}\times 100$$

FIG. 10 shows the relationship between various conditions and the liquid leakage rate and collection rate. In FIG. 10, liquid leakage rate determination results "AA", "A", "B", and "C" correspond to a liquid leakage rate of 5% or less, that of 5% (inclusive) to 10% (exclusive), that of 10% (inclusive) to 20% (exclusive), and that of 20% or more, respectively. Collection rate determination results "AA", "A", "B", and "C" correspond to a collection rate of 60% or more, that of 30% (inclusive) to 60% (exclusive), that of 15% (inclusive) to 30% (exclusive), and that of 15% or less, respectively.

Figure 11A:
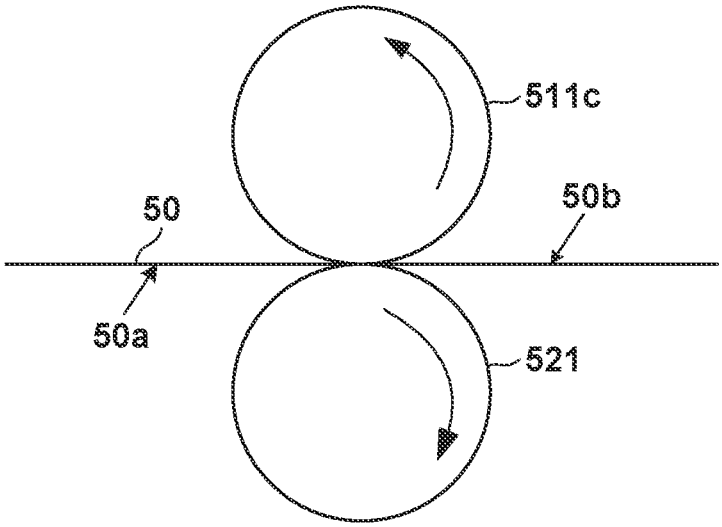
FIGS. 11A and 11B are views for explaining the contact state between a liquid absorbing member and a cleaning roller and a driven rotating body facing it.

Referring to FIG. 10, Examples 1 to 3 are examples when a porous material having 3 μm in an average pore size of a single layer and 1.5 MPa in compressive modulus was used as the liquid absorbing member 50. The nipping pressure of cleaning unit 52 in Examples 1 and 2 among these examples was 0.1 MPa and the nipping pressure in Example 3 was 0.15 MPa. The nipping pressure of the collection unit 54 increased in order of Examples 1 to 3. In each example, the nipping pressure of the collection unit 54 that collects the liquid is set higher than that of the cleaning unit 52 that is used to clean the liquid absorbing member 50. Note that FIG. 11A shows a state in which the liquid absorbing member 50 is nipped by the cleaning unit 52 in these examples. Note also that in FIG. 11A, the liquid absorbing member 50 has a lower surface as a first surface 50*a* contacting the ink image and an upper surface as a second surface 50*b*.

To evaluate Examples 1 to 3, Comparative Examples 1 and 2 will be described in which a porous material having 3 μm in average pore size of a single layer and 1.5 MPa in compressive modulus was used as the liquid absorbing member 50, similarly to Examples 1 to 3. Note that in the comparative examples, the nipping pressure of the collection unit 54 that collects the liquid is set lower than that of the cleaning unit 52 that is used to clean the liquid absorbing member 50. Note also that as is apparent from Examples 1 to 3 and Comparative Examples 1 and 2, as the nipping pressure of the cleaning unit 52 increases, a contact area between the liquid absorbing member 50 and the nipping portion of the cleaning unit 52 increases. This is because as the nipping pressure becomes higher, an area of the liquid absorbing member 50 where the pressure is detected increases.

By comparing Examples 1 to 3 with Comparative Examples 1 and 2, Examples 1 to 3 are superior to Comparative Examples 1 to 2 in terms of the liquid leakage rate and the collection rate. That is, when the nipping pressure of a collection portion (collection unit 54) that collects the liquid is set to be higher than that of a cleaning portion (cleaning unit 52) that is used to clean the liquid absorbing member 50, it is possible to reduce liquid leakage and effectively collect the liquid. Particularly, in Example 3, the nipping pressure of the cleaning portion is set to 0.15 MPa that is equal to 10% of the compressive modulus of the porous material forming the liquid absorbing member 50. To the contrary, in the comparative examples, the nipping pressure is set to a value exceeding 0.15 MPa, resulting in deterioration in liquid leakage rate. Therefore, the nipping pressure of the cleaning portion is appropriately set to a value equal to or less than 10% of the compressive modulus of the porous material forming the liquid absorbing member 50 or set to 0.15 MPa or lower. While the nipping pressure of the collection portion is set to 0.15 MPa in Example 1, the nipping pressure is set to a value lower than 0.15 MPa in the comparative examples. As a result, in the comparative examples, the collection rate lowers. Thus, the gripping pressure of the collection portion is appropriately set to 0.15 MPa or higher. However, if the gripping pressure of the collection portion is set to 0.15 MPa, the gripping pressure of the cleaning portion should be set lower than 0.15 MPa, and if the gripping pressure of the cleaning portion is set to 0.15 MPa, the gripping pressure of the collection portion should exceed 0.15 MPa. By comparing Examples 1 to 3, it could be confirmed that as the gripping pressure of the collection portion increased, the collation rate also increased.

Examples 4 to 7 are examples in which an arrangement formed from two layers, that is, a porous material of an obverse layer and a porous material of a reverse layer that have different properties is used as the liquid absorbing member 50. As shown in Examples 4 to 7, the average pore size of the porous material of the reverse layer is larger than that of the porous material of the obverse layer. The reason for this is to squeeze the liquid component absorbed in the obverse layer from the reverse layer without flowing backward to the obverse layer in the collection portion. Note that in the examples, the double layer structure is used. However, the same effect can be obtained by using a porous material formed so that the average pore size in the thickness direction changes so as to increase from a surface contacting the ink image to a surface from which the liquid is squeezed. The liquid absorbing member 50 according to Examples 4 to 7 is configured so that the compressive modulus of the reverse layer is lower than that of the obverse layer. Tables 2 and 3 show the arrangements and physical properties of the porous materials used for the liquid absorbing member 50 in Examples 4 to 6 and Example 7, respectively.

TABLE 2

| | Porous Material | | | | |
|---|---|---|---|---|---|
| | Material | Thickness | Porosity | Average Pore Size | Compressive Modulus |
| Obverse Layer | PTFE | 30 μm | 80% | 3 μm | 1.5 |
| Reverse Layer | PET | 190 μm | 75% | 20 μm | 0.8 |
| Physical Properties of Porous Material after Integration with Heat Pressure Lamination | | | Gurley value G1: 4.0 s | | |

TABLE 3

| | Porous Material | | | | |
|---|---|---|---|---|---|
| | Material | Thickness | Porosity | Average Pore Size | Compressive Modulus |
| Obverse Layer | PTFE | 10 μm | 80% | 0.2 μm | 1.5 |
| Reverse Layer | PET | 190 μm | 75% | 20 μm | 0.8 |
| Physical Properties of Porous Material after Integration with Heat Pressure Lamination | | | Gurley value G1: 8.0 s | | |

Note that similarly to Examples 1 to 3, in Examples 4 to 7, the nipping pressure of the collection portion is set to be higher than that of the cleaning portion.

Figure 11B:
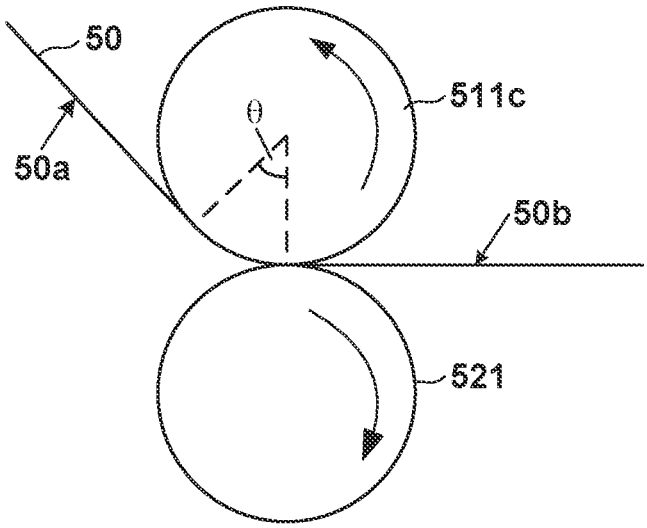

The arrangement of the cleaning portion according to Example 4 among Examples 4 to 7 is as shown in FIG. 11A, similarly to Examples 1 to 3. On the other hand, in Examples 5 to 7, the liquid absorbing member 50 is wound around a driven rotating body 511*c* so that an area where the second surface 50*b* of the liquid absorbing member 50 contacts the nipping portion is larger than that where the first surface 50*a* contacts the nipping portion. FIG. 11B shows this state. In FIG. 11B, θ represents a winding angle. As the winding angle θ is larger, the area where the second surface 50*b* of the liquid absorbing member 50 contacts the nipping portion is larger.

As is apparent from Examples 4 to 7, the same effect as in Examples 1 to 3 can be obtained by using the liquid absorbing member 50 formed by the porous material of the two layers and setting the nipping pressure of the collection portion higher than that of the cleaning portion. By comparing Example 4 with Examples 5 to 7, it is understood that the area where the second surface 50*b* of the liquid absorbing member 50 contacts the nipping portion is larger than that where the first surface 50*a* of the liquid absorbing member 50 contacts the nipping portion, and thus the liquid leakage rate and the collection rate are improved. Furthermore, by comparing Examples 6 and 7 with each other, it is understood that the liquid leakage rate is further improved by further decreasing the average pore size of the obverse layer.

According to the above-described examples, it is possible to suppress occurrence of liquid leakage in the apparatus and improve the liquid collection efficiency by setting the nipping pressure of the collection portion higher than that of the cleaning portion or the like. In addition, it is possible to improve the liquid leakage rate and the collection rate in accordance with the material of the liquid absorbing member 50, the liquid absorbing position, and a method of bringing the liquid absorbing member 50 into contact with the nipping portion other than the collection portion.

Note that, for example, a moving mechanism can adjust the nipping pressure of the collection portion or that of another nipping portion. For example, it is possible to relax the pressure at the time of replacement of the liquid absorbing member 50. Then, at the time of use, the moving mechanism can be controlled so that the nipping pressure of the collection portion becomes higher than that of the cleaning portion or the like or so that the nipping pressure of the collection portion or another portion becomes higher than the nipping pressure of the collection portion.

Note that the nipping portion other than the collection portion in the above-described examples is not limited to the cleaning portion. For example, the printing system 1 includes one or more nipping portions such as the preprocessing unit 55 that applies the recovery liquid lower in viscosity than the liquid absorbed by the first surface of the liquid absorbing member 50 and the application unit 53 that applies the moisturizing liquid to the liquid absorbing member 50. The nipping pressures of these nipping portions are also set lower than that of the nipping portion of the collection portion. In addition, a driven rotating body 511*a* may be provided at a position facing a drive rotating body 510, and the liquid absorbing member 50 may be configured to be nipped by the drive rotating body 510 and the driven rotating body 511*a*. At this time, the nipping pressures of the drive rotating body 510 and the driven rotating body 511*a* are set lower than that of the collection portion. Note that the nipping pressure of the collection portion may be set higher than all nipping pressures of the plurality of nipping portions except for the collection portion and the contact portion between the liquid absorbing member 50 and the transfer member 2 but may be set lower than the nipping pressures of some of the plurality of nipping portions. That is, if there are a plurality of nipping portions in addition to the collection portion and the contact portion between the liquid absorbing member 50 and the transfer member 2, the nipping pressures of some of the plurality of nipping portions may be higher than that of the collection portion.

The nipping portion may have a roller shape, as described above, and may also have another shape.

Figure 12:
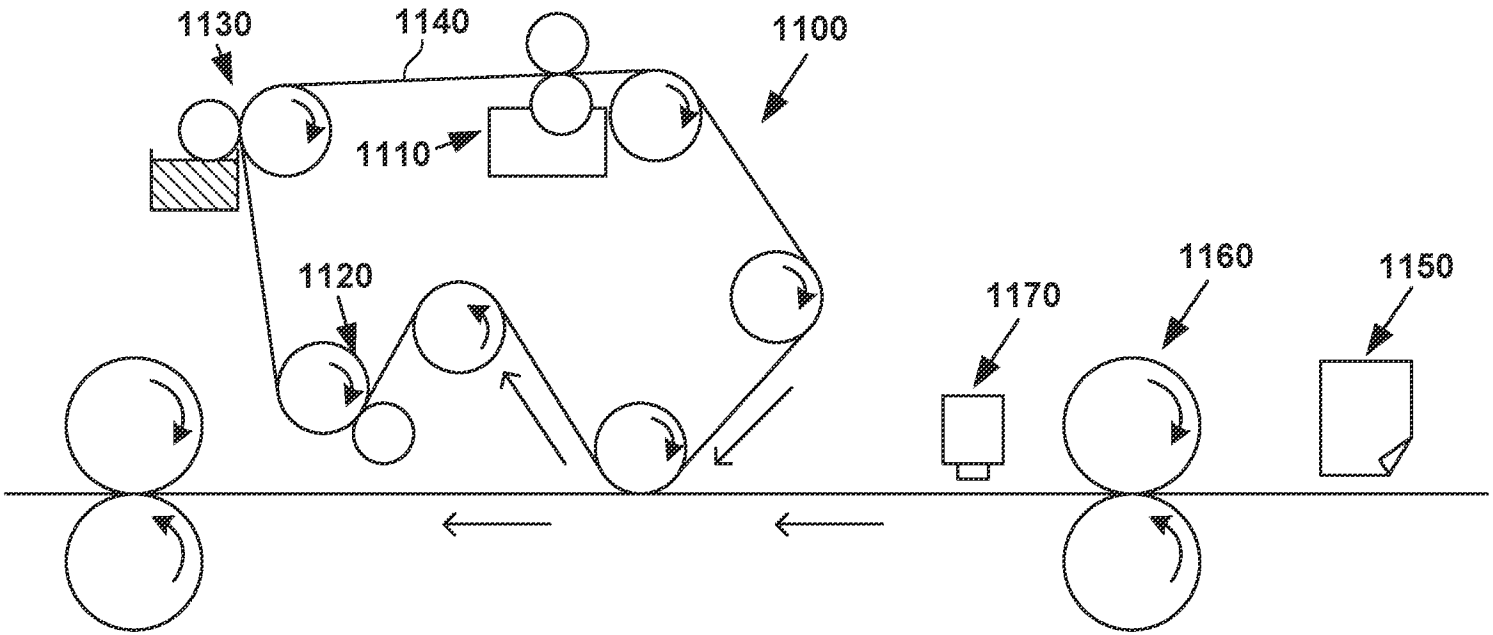
FIG. 12 is a view for explaining another application of a liquid absorbing apparatus.

Note that the above-described embodiment has explained the absorption unit 5B that absorbs the liquid component from the ink image formed on the transfer member. The present invention, however, is not limited to this. For example, the same arrangement as that of the above-described absorption unit 5B can be used as a liquid absorbing apparatus when absorbing the liquid component from the ink image formed on the print medium such as paper. FIG. 12 shows an example of the arrangement in this case. Referring to FIG. 12, reference numeral 1100 denotes a liquid absorbing apparatus. Note that this liquid absorbing apparatus 1100 can have the same arrangement as that of the absorption unit 5B described above. However, FIG. 12 shows a simplified structure. In this arrangement, a conveyance apparatus 1160 conveys a print medium 1150, an ink application apparatus 1170 forms an ink image on the print medium 1150, and the liquid absorbing apparatus 1100 absorbs a liquid from the ink image on the print medium 1150. In this case as well, the liquid absorbing apparatus 1100 is configured to absorb a liquid component by making a liquid absorbing sheet 1140 contact the ink image, squeeze, by a collection mechanism 1110, the liquid component absorbed by the liquid absorbing sheet 1140, and collect it. The liquid absorbing apparatus 1100 includes nipping portions such as a driving unit 1120 and a cleaning unit 1130 in each of which the liquid absorbing sheet is nipped. At this time, the nipping pressure of the nipping portion in the collection mechanism 1110 is set higher than that of the nipping portion in, for example, the driving unit 1120 or the cleaning unit 1130. This can suppress liquid leakage in the liquid absorbing apparatus 1100, and improve the collection efficiency of the liquid component.

<Another Embodiment of System>

In the above embodiment, the print unit 3 includes the plurality of printheads 30. However, an arrangement may include one printhead 30. The printhead 30 need not be a full-line head but may be of a serial type that forms an ink image by discharging ink from the printhead 30 while a carriage that mounts the printhead 30 moves in a Y direction.

A conveyance mechanism of a print medium P may adopt another method such as a method of nipping and conveying the print medium P by a pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and cyclically rotating and moving it may be used.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131491, filed Jul. 4, 2017, which is hereby incorporated by reference herein in its entirety.

What is claimed is:

1. A printing apparatus comprising:

a transfer member configured to be moved cyclically;

a print unit configured to form an ink image on the transfer member by discharging ink to the transfer member;

a transfer unit configured to perform a transfer operation of transferring, to a print medium, the ink image formed on the transfer member; and a liquid absorbing unit configured to absorb a liquid component from the ink image on the transfer member before the transfer operation, the liquid absorbing unit including:

an endless liquid absorbing sheet, a driving unit configured to move the liquid absorbing sheet cyclically, an absorption unit configured to absorb the liquid component from the ink image by making the liquid absorbing sheet contact the ink image, a removing unit configured to squeeze and remove a liquid with a nipping pressure by nipping the liquid absorbing sheet, and at least one nipping unit, different from the absorption unit and the removing unit, configured to nip the liquid absorbing sheet, wherein the nipping pressure of the removing unit is set higher than a nipping pressure of the nipping unit.

2. The apparatus according to claim 1, wherein the nipping unit includes a cleaning unit configured to clean the liquid absorbing sheet.

3. The apparatus according to claim 1, wherein the nipping unit includes an application unit configured to apply a recovery liquid that is lower in viscosity than the liquid component.

4. The apparatus according to claim 1, wherein the absorption unit and the nipping unit include rollers configured to nip the liquid absorbing sheet.

5. The apparatus according to claim 1, wherein the nipping unit includes the driving unit.

6. The apparatus according to claim 1, wherein the nipping pressure of the removing unit is not lower than 0.15 MPa.

7. The apparatus according to claim 1, wherein the nipping pressure of the nipping unit is not higher than 0.15 MPa.

8. The apparatus according to claim 1, wherein the liquid absorbing sheet is made of a porous material including at least two layers of an obverse layer contacting the ink image and a reverse layer not contacting the ink image.

9. The apparatus according to claim 8, wherein an average pore size of the reverse layer is larger than an average pore size of the obverse layer.

10. The apparatus according to claim 8, wherein in the nipping unit, an area where the nipping unit contacts the obverse layer is smaller than an area where the nipping unit contacts the reverse layer.

11. The apparatus according to claim 8, wherein a compressive modulus of the obverse layer is higher than a compressive modulus of the reverse layer.

12. The apparatus according to claim 1, wherein the nipping pressure of the nipping unit is not higher than 10% of a compressive modulus of a porous material forming the liquid absorbing sheet.

13. The apparatus according to claim 1, wherein the liquid absorbing sheet is made of a porous material whose average pore size changes in a thickness direction.

14. The apparatus according to claim 1, wherein the removing unit nips the liquid absorbing sheet with a highest nipping pressure, other than a nipping pressure of the absorption unit.

15. A liquid absorbing apparatus for absorbing a liquid component from a formed ink image, the liquid absorbing apparatus comprising:

an endless liquid absorbing sheet;

a driving unit configured to move the liquid absorbing sheet cyclically;

an absorption unit configured to absorb the liquid component from the ink image by making the liquid absorbing sheet contact the ink image;

a removing unit configured to squeeze and remove a liquid with a nipping pressure by nipping the liquid absorbing sheet; and at least one nipping unit, different from the absorption unit and the removing unit, configured to nip the liquid absorbing sheet, wherein the nipping pressure of the removing unit is set higher than a nipping pressure of the nipping unit.

16. A control method for a liquid absorbing apparatus including a liquid absorbing unit configured to absorb a liquid component from a formed ink image, the liquid absorbing unit including an endless liquid absorbing sheet, a driving unit configured to move the liquid absorbing sheet cyclically, an absorption unit configured to absorb the liquid component from the ink image by making the liquid absorbing sheet contact the ink image, a removing unit configured to squeeze and remove a liquid with a nipping pressure by nipping the liquid absorbing sheet, and at least one nipping unit, different from the absorption unit and the removing unit, configured to nip the liquid absorbing sheet, the method comprising controlling at least one of the removing unit and the nipping unit so that the nipping pressure of the removing unit becomes higher than a nipping pressure of the nipping unit.

17. The method according to claim 16, wherein the nipping unit includes a cleaning unit configured to clean the liquid absorbing sheet.

18. The method according to claim 16, wherein the nipping unit includes an application unit configured to apply a recovery liquid lower in viscosity than the liquid component.

19. The method according to claim 16, wherein the nipping pressure of the removing unit is not lower than 0.15 MPa.

20. The method according to claim 16, wherein the nipping pressure of the nipping unit is not higher than 0.15 MPa.

* * * * *